US009511833B2

(12) United States Patent
Scott et al.

(10) Patent No.: US 9,511,833 B2
(45) Date of Patent: Dec. 6, 2016

(54) MULTI-COMPONENT ROBOT FOR BELOW ICE SEARCH AND RESCUE

(71) Applicant: Natick Public Schools, Natick, MA (US)

(72) Inventors: Doug Scott, Stow, MA (US); Adam Azanow, Natick, MA (US); Daniel Carson, Framingham, MA (US); William Coburn, Natick, MA (US); Nicholas Exarchos, Natick, MA (US); Russell Forrest, Norfolk, MA (US); Jason Geller, Natick, MA (US); Ford Grundberg, Natick, MA (US); Kimya Harper, Natick, MA (US); Susan Haverstick, Natick, MA (US); Larion Johnson, Hyde Park, MA (US); Kevin King, Uxbridge, MA (US); James Kinsey, North Falmouth, MA (US); Alex Krasa, Natick, MA (US); Ilir Kumi, Natick, MA (US); Douglas Laderman, Natick, MA (US); Jonathan Magee, Natick, MA (US); James McLean, Natick, MA (US); Alex Petrovsky, Natick, MA (US); Katelyn Sweeney, Natick, MA (US); Nickolas Thorsen, Natick, MA (US); Olivia Van Amsterdam, Natick, MA (US); Jacob Wainer, Natick, MA (US); Chris Williamson, Natick, MA (US); Ethan Ziegler, Natick, MA (US)

( * ) Notice: Subject to any disclaimer, the term of this patent is extended or adjusted under 35 U.S.C. 154(b) by 0 days.

(21) Appl. No.: 14/260,144

(22) Filed: Apr. 23, 2014

(65) Prior Publication Data

US 2014/0360420 A1 Dec. 11, 2014

Related U.S. Application Data

(60) Provisional application No. 61/814,986, filed on Apr. 23, 2013.

(51) Int. Cl.

| | |
|---|---|
| ***B63C 11/34*** | (2006.01) |
| ***B63C 11/48*** | (2006.01) |
| ***B63G 8/08*** | (2006.01) |
| *B63G 8/00* | (2006.01) |

(52) U.S. Cl.

CPC ..... *B63G 8/08* (2013.01); *B63C 11/34* (2013.01); *B63C 11/48* (2013.01); *B63G 2008/007* (2013.01); *Y10S 901/08* (2013.01); *Y10S 901/47* (2013.01)

(58) Field of Classification Search

CPC ..... B63C 1/34; B63C 1/42; B63C 1/48; B63C 13/0011; B63G 2008/005; B63G 2008/007

See application file for complete search history.

(56) References Cited

U.S. PATENT DOCUMENTS

| | | | | |
|---|---|---|---|---|
| 4,010,619 | A * | 3/1977 | Hightower et al. | 405/191 |
| 4,721,055 | A * | 1/1988 | Pado | 405/191 |
| 6,260,504 | B1 * | 7/2001 | Moles et al. | 114/312 |
| 7,597,811 | B2 * | 10/2009 | Usher | 210/747.4 |

(Continued)

*Primary Examiner* — Frederick L Lagman

(74) *Attorney, Agent, or Firm* — Wolf, Greenfield & Sacks, P.C.

(57) ABSTRACT

The invention relates to remotely operated multi-component search robots for underwater search and rescue operations, and particularly suited for searches under ice.

9 Claims, 9 Drawing Sheets

(56) References Cited

U.S. PATENT DOCUMENTS

| | | | | |
|---|---|---|---|---|
| 2005/0276665 | A1* | 12/2005 | Entralgo et al. | 405/190 |
| 2010/0005857 | A1* | 1/2010 | Zhang et al. | 73/29.02 |
| 2010/0260553 | A1* | 10/2010 | Bryn et al. | 405/191 |

* cited by examiner

MULTI-COMPONENT ROBOT FOR BELOW ICE SEARCH AND RESCUE

RELATED APPLICATION

This application claims the benefit under 35 U.S.C. §119(e) of U.S. provisional application Ser. No. 61/814,986, filed Apr. 23, 2013, the disclosure of which is incorporated by reference herein in its entirety.

BACKGROUND OF THE INVENTION

The field of search-and-rescue diving is extremely dangerous, and many of the safety protocols take a significant amount of time, increasing the amount of time not only the diver but also the victim has to spend in the water. It also is difficult to see underwater below ice, due to a lack of sunlight, murky water, and due to the diver stirring up silt from the bottom of the body of water. Complicating matters in regions that suffer freezing winters, it is dangerous to stage search and rescue operations on frozen bodies of water because the ice may not be able to safely bear the weight of the diver's support team and equipment where the search takes place. Also, visibility is reduced in waters covered by ice, and dives are generally more difficult.

SUMMARY OF THE INVENTION

To alleviate the danger and other difficulties for rescue operations underwater below ice by first responders, the invention provides a remotely operated multi-component search robot that is particularly suited for searches under ice. A first remotely operated vehicle (ROV) adapted for travel on solid surfaces, such as land and ice, carries a second, submersible ROV to an underwater search area, such as an opening in the ice on a pond, and deploys the second ROV into the water. The submersible ROV can carry out the preliminary search pattern to locate and identify the target, e.g., as a human victim, for divers. Once it has reached the target, it can remain by the target until a diver enters the water. A diver can then follow the ROV's tether in order to safely locate the victim, decreasing the time spent in the water for both the diver and the victim, and thus increasing the safety and success rates of the dives. Where time is of the essence, such as for rescue operations, the search robot can provide an extra set of eyes for divers who are already in the water, and signal them when the target is found. This helps increase the safety and speed of these dives, keeping divers from having to unnecessarily endanger themselves and decreasing the total time the target spends in the water.

Thus, to alleviate the danger and other difficulties for rescue operations underwater below ice by first responders, the invention provides a multi-component robot that can be used in underwater search and rescue operations, including under ice. The multi-component robot includes a submersible ROV, a non-submersible ROV that can traverse ice and other substantially solid surfaces, and a connector mechanism that connects the submersible ROV to the non-submersible ROV. The three components are connected via electronic linkages to convey visual and other information to an operator, and to permit remote control of the multi-component robot by the operator.

DETAILED DESCRIPTION OF THE INVENTION

Figure 1:
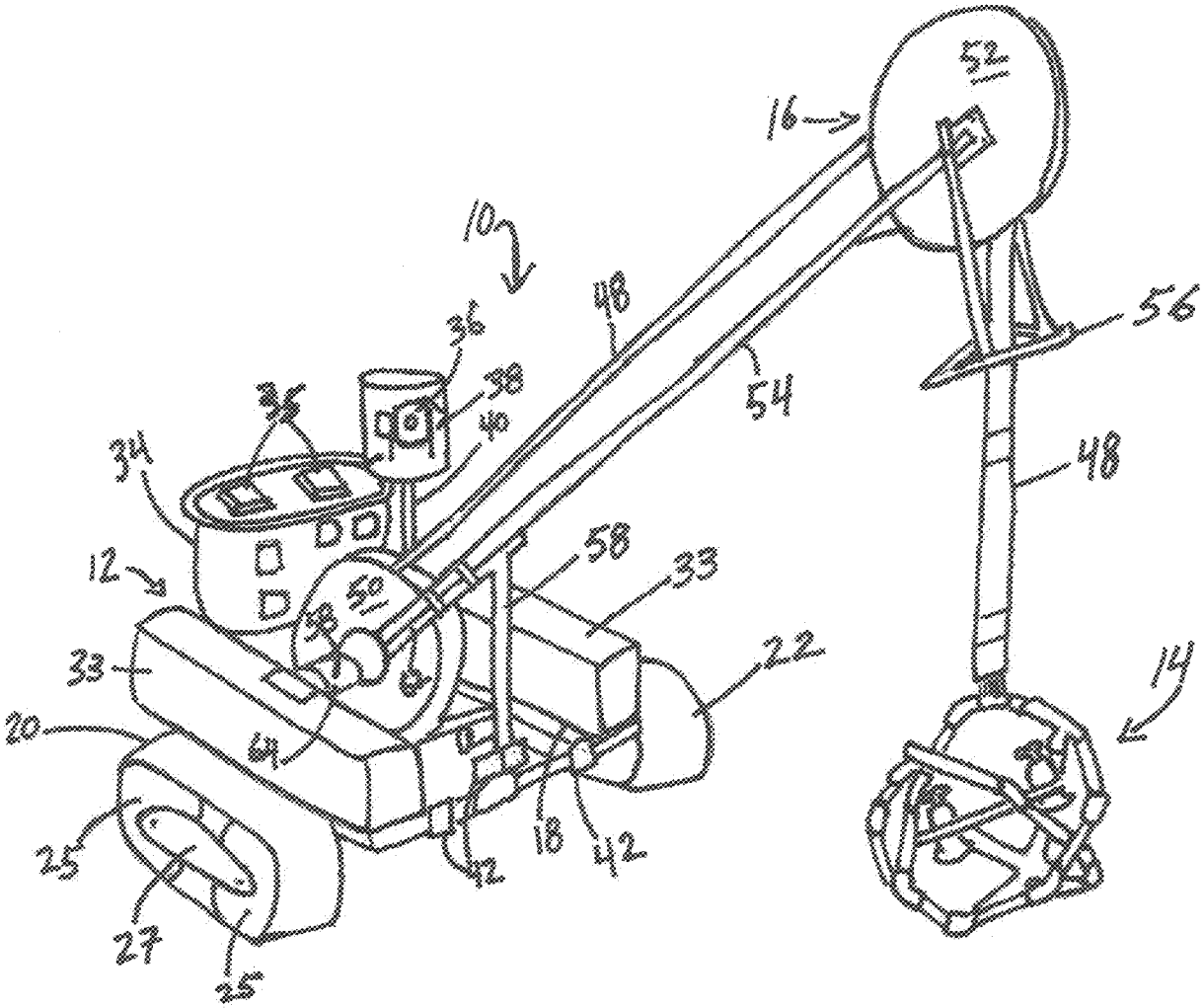
FIG. 1 is a perspective view of an embodiment of the multi-component device of the invention, in which a land ROV is shown with the submersible ROV.
Figure 2:
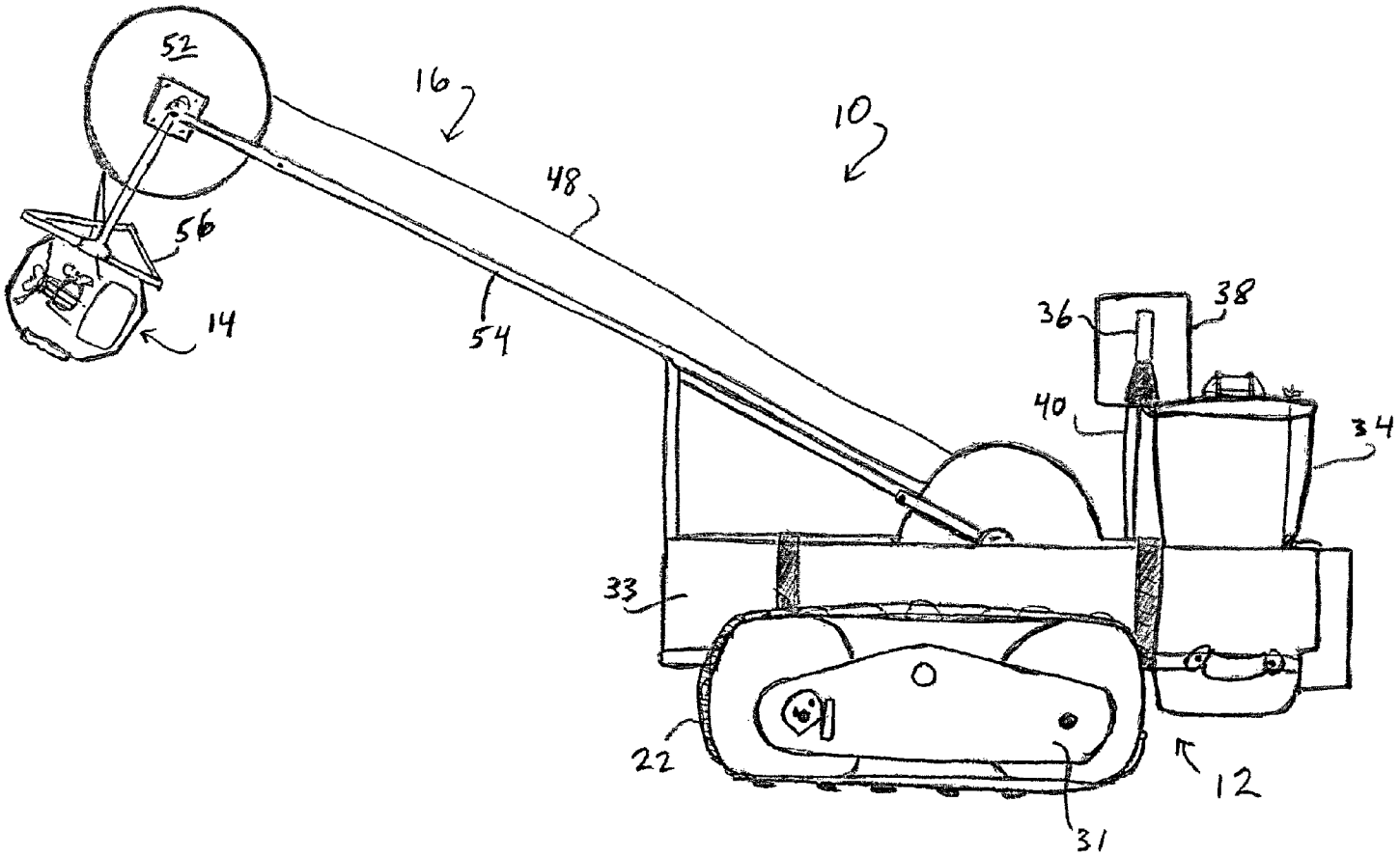
FIG. 2 is a left side view of the multi-component device shown in FIG. 1.
Figure 3:
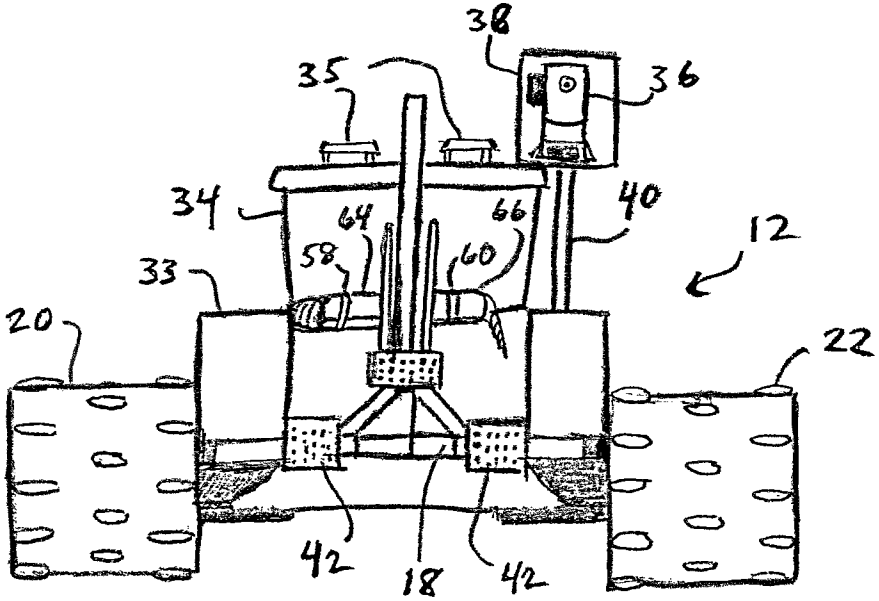
FIG. 3 is a front view of the land ROV device shown in FIG. 1.
Figure 4:
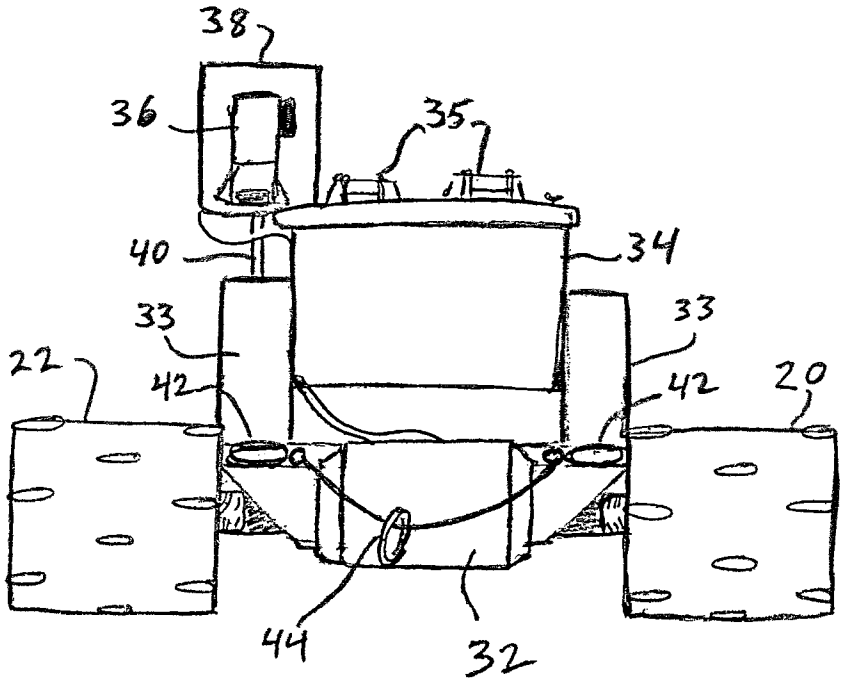
FIG. 4 is a rear view of the land ROV
Figure 5:
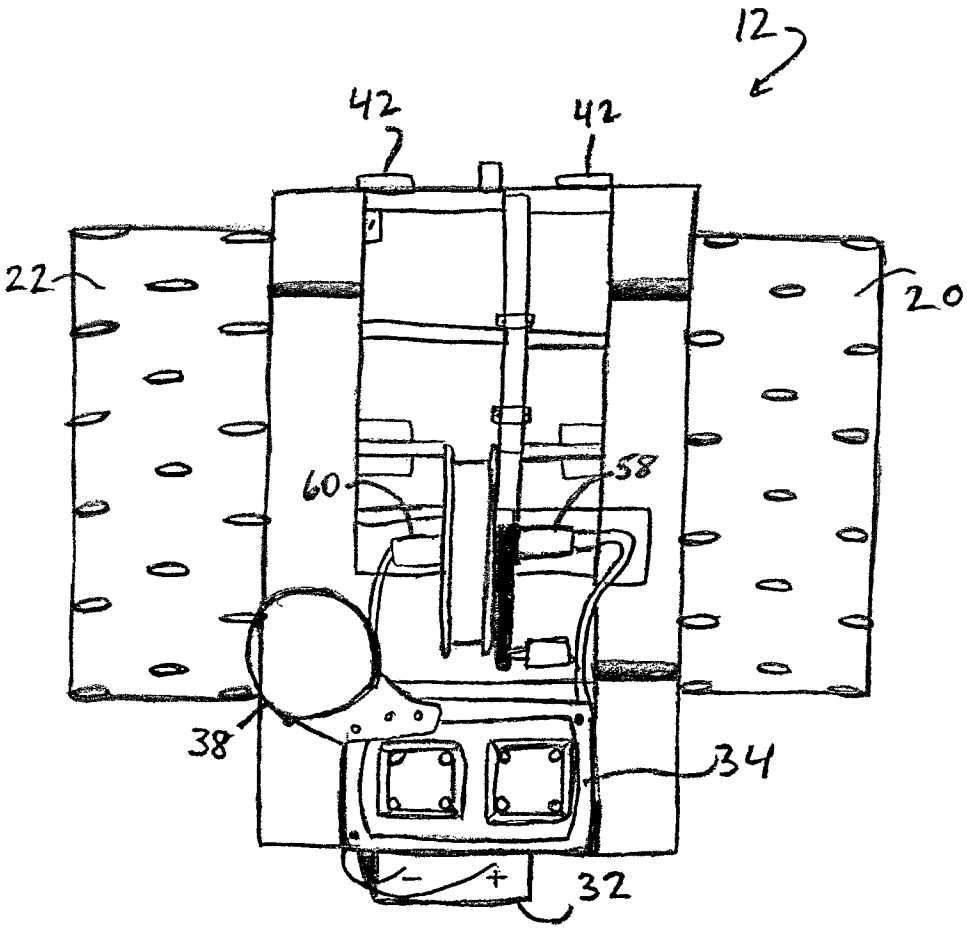
FIG. 5 is a top view of the land ROV.
Figure 6:
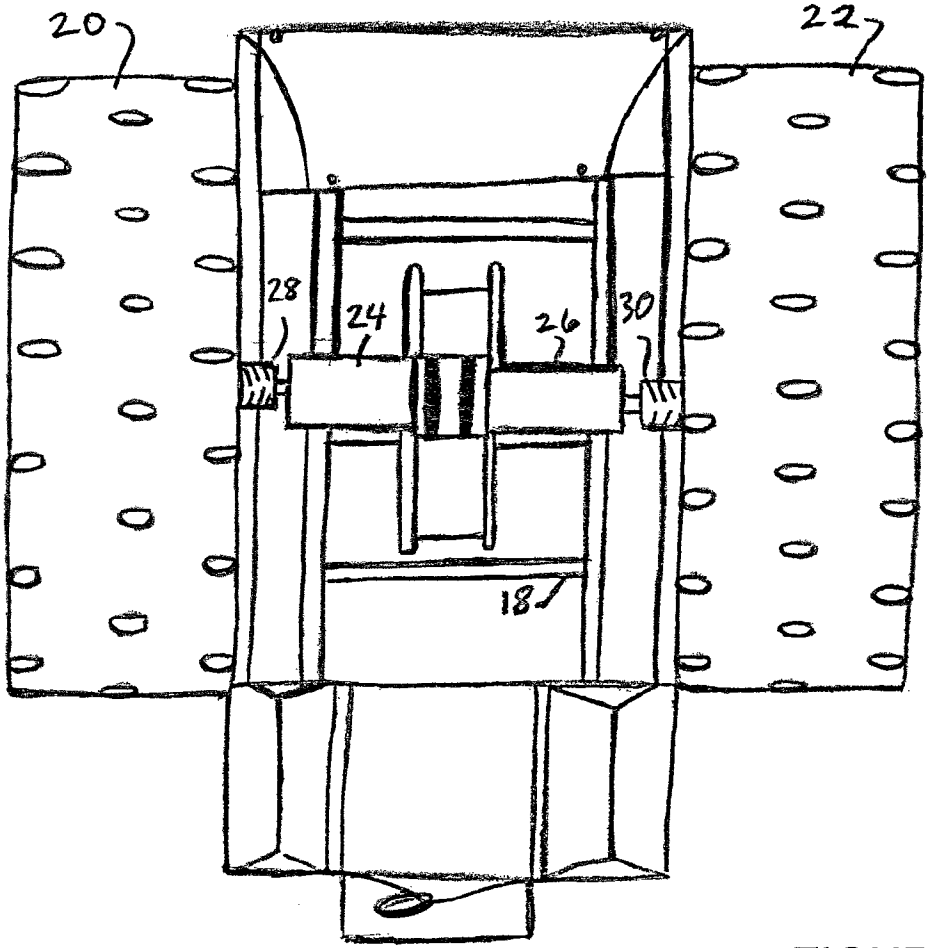
FIG. 6 is a bottom view of the land ROV.

A multi-component, remotely operated search robot contains several components, each of which has a distinct function and all of which are connected mechanically and electrically. Referring to FIGS. 1-2, an embodiment of the invention 10 includes a remotely operated surface ROV 12, a submersible search ROV 14, and a connector unit 16 that is mounted on the surface ROV 12 and that can carry, deploy, and retrieve the search ROV 14 using a retractable tether 18. An operator can remotely control the surface ROV 12 from a safe location, or staging area, to move across the surface ice on a body of water to a position near an opening in the ice. The operator can then control the connector unit 16 to deploy the submersible unit 14 into the water, and also control the movement of the submersible unit 14 in the water.

Surface ROV

Referring now also to FIGS. 1-6 (in which the connector unit boom is not shown for clarity), in which the surface ROV 12 may also be referred to herein as the "land vehicle" or the "land bot". The land vehicle includes a frame 18 upon which are mounted the remaining parts of the land vehicle, including power part(s), electronics part(s), information-gathering part(s), propulsion part(s), and floatation part(s). The frame 18 can be constructed of any lightweight and sturdy material, such as aluminum or PVC pipe. In the illustrated embodiment, the frame 18 is made of lightweight aluminum.

The information-gathering part(s), electronics part(s), power part(s), flotation part(s) and propulsion part(s) are connected to the frame 18 by any fastener materials or fastener devices. Fastener materials can include glues and epoxies. Fastener devices can include brackets, bolts, screws, and plates.

Propulsion of the surface ROV 12 is provided by a pair of wheeled treads 20, 22 that that are independently powered by a pair of respective reversible electric traction motors 24, 26, which allows for independent control and tighter turning. Each tread is driven by two wheels 25, which are connected to a tensioner that maintains position of the wheels to permit them to drive the treads. The wheels are protected from exterior elements by plates 27 mounted on the frame 13. The treads could be substituted by four wheels with tires, or treads with non-rubber tracks, or two rear-mounted wheels with front-mounted skis for traveling over snow.

Power from the motors is transferred via helical couplings 28, 30 and sprocket and chain drives 31 for each tread. In the described embodiment, electric power for the motors and other electronic parts of the surface ROV 12 is provided by a single 12 volt lead acid automobile battery 32. Other types of traction batteries could be substituted for the automobile battery, such as a different kind of battery, or a plurality of smaller batteries. The power source should provide adequate power for the land vehicle's parts, such as the electronics parts, camera, and motors. In this embodiment, the battery 32 is mounted at the rear of the land vehicle frame, which provides a counter weight to the connector component 16 that is mounted toward the front of the land vehicle frame. Power also can be supplied to the land vehicle from an external source, such as through a power cord connected to a power source on the shoreline.

Flotation devices, such as closed-cell, polystyrene foam blocks 33, are mounted above the frame 18 on either side of the surface ROV 12 to keep it afloat should it fall through the ice into water. In some embodiments, the float may be an inflatable device that inflates when the vehicle falls into the water, such as by triggering a water-sensing switch that activates an inflation device, such as a pump or source of compressed gas. There is also an emergency retrieval hitch 44 at the rear to which a retrieval cable can be attached.

Electronics parts, in the described embodiment, are contained within a water resistant housing, which is referred to herein (with all enclosed parts) as the electronics box 34. The electronics box 34 contains and provides connections for various power and information cables, including between the search ROV 14 and the land vehicle 12, allowing for each to be controlled remotely. The electronics box 34 also contains a Wi-Fi router that is in electronic communication with the ROV and land vehicle cameras, and which sends video images from a search ROV camera and the land vehicle camera to a display (e.g., laptop computer), which may be located on land or a safe staging area on the ice, and is viewed by the remote operator. The Wi-Fi router also receives control signals from the remote operator, and sends the control signals to the motors and thrusters on both the land vehicle 12 and the search ROV 14, thereby allowing for the land vehicle and ROV to be wirelessly and remotely controlled by the operator. The electronics box also is connected to the power source, such as the automobile battery 32, and distributes electricity to the various parts on the land vehicle 12 and mechanisms in the connector unit 16 for deploying and retrieving the search ROV, and to the search ROV 14 for its operation and control that require it, including the lights, camera, motors, etc. The electronics box 34 may have fans 35 connected to it to lower the temperature in the electronics box to prevent overheating of the various electronic components disposed in the electronics box 34.

The surface ROV 12 includes a video camera 36 that is inside a clear water resistant housing 38. It operates to provide video images from the land vehicle's point of view to let the remote operator know where to drive the land vehicle 12 in order to release the search ROV 14, such as into a hole in the ice. In the described embodiment, the camera container 38 is mounted on a small camera pole 40 that is mounted vertically on the frame 18, which elevates the camera 36 and thereby provides a better view of the surroundings, such as a hole in the ice toward which the land vehicle is driven. Alternatively, the portion of the land vehicle frame on which the camera is mounted can be shaped or configured to provide elevation for the camera. The camera is connected, typically via the electronics box, to the power source and to the Wi-Fi router, which provides the images gathered by the camera to the operator's display.

The instrumentation may also include one or more lights 42 to illuminate the surface ROV's path and objects viewed by the camera, and thereby to provide a clearer image, particularly in low-light situations. In some embodiments, the lights 42 are LEDs. The lights in some embodiments are encased in a waterproof, light-transmissible housing, such as a clear waterproof case, or are molded into clear solid casings, which may be formed of clear epoxy or polymeric materials. The lights 42 are mounted on the land vehicle frame 18 using fastener materials or fastener devices as described herein. The land vehicle also can have other lights to provide for ready detection of the land vehicle in case it falls into the water.

Connector Component

The connector component 16 is adapted to carry the search ROV 14 securely while traveling on land or ice, to deploy the search ROV into the water, and retrieve it after an underwater search is completed. It also provides power and control signals to the search ROV, and transmits the search ROV's sensor signals to the surface ROV's communications router.

The search ROV 14 is physically and communicatively connected to the surface ROV 12 by a flexible tether 48. The tether 48 serves as the physical, power, and communication connector between the surface ROV 12 and the search ROV 14 to enable its remote operation. The tether's other function is to deploy the search ROV into position for searching, such as through a hole in the ice. In the described embodiment, the tether 48 is a flexible, flat, waterproof, multi-wire cable. The wires in the tether include power wires for the search ROV 14 thrusters, sensors, and lights, and an Ethernet cable for providing sensor signals from the search ROV 14 to the router on the surface ROV. The tether 48 is wound on a spool 50 that is rotatably mounted on a proximal end of a forward facing boom 54 on the surface ROV 12, extends over a pulley 52 that is mounted on a distal end of the boom 54, through a retaining ring 56 and to an attachment point to the search ROV 14. Slip-ring connectors 58 and 60 provide power and communication connections from the surface ROV 12 to the tether on either side of the spool 50.

The tether 48 is sufficiently flexible and has sufficient tensile strength to permit winding on the spool 50 and to support the weight of the ROV, particularly before the ROV is placed in the water. In the described embodiment, the tether is made of duct tape encasing the wires leading to the ROV parts. In some embodiments, the tether could be made of a casing that has the ability to hold the wires leading to the ROV parts.

The boom 54 is rigidly connected to the frame 18 of the land vehicle 12 and is supported by a framework of struts 62 that are also connected to the surface ROV frame 18. The boom and struts can be constructed of any lightweight, strong material(s) such as metal (such as aluminum) and/or plastic. Preferably the materials should be strong, lightweight and rigid, so as to have the ability to support a long tether and the search ROV 14. In the described embodiment, the material is aluminum.

The spool 50 is mounted on the boom 54 proximal to the land vehicle and is operated by boom motors 64, 66 controlled by the remote operator. The function of the boom motor is to rotate the spool to deploy and retrieve the search ROV 14 with the tether 48. The boom motors 64, 66 turn a belt 68, which cause the spool 50 to spin, making the tether extend or retract as directed by the remote operator. The boom motors 64, 66 are powered by the battery 32 mounted on the land vehicle. In some embodiments, the boom motors 64, 66 may be powered by a power line from land. The belt 68 maintains synchronization of the boom motors 64, 66.

The spool 50 and propulsion parts are connected to the frame of the boom by any fastener materials or fastener devices. Fastener materials can include glues and epoxies.

Fastener devices can include brackets, bolts, screws, and plates. The boom 54 is mounted on the land vehicle frame 18 using fastener materials or fastener devices as described herein. The boom 54 also can be welded to the land vehicle frame 12.

The tether 48 is let out, by being spun off the spool 50 that is mounted on the boom 54 proximal to the land vehicle, until the search ROV is safely deployed within the hole, and continues to remain attached to the search ROV until the ROV is brought back from the hole. The retaining ring, or tether guide 56, serves to limit the swinging motion of the tether 48 and connected search ROV 14. The tether guide 56 can be made of any material that does not interfere with or damage the tether. In a preferred embodiment, the tether guide 56 is made of PVC pipe, but other materials including rings or other open shapes made of metals, plastics etc. may be used.

Search ROV

Figure 7:
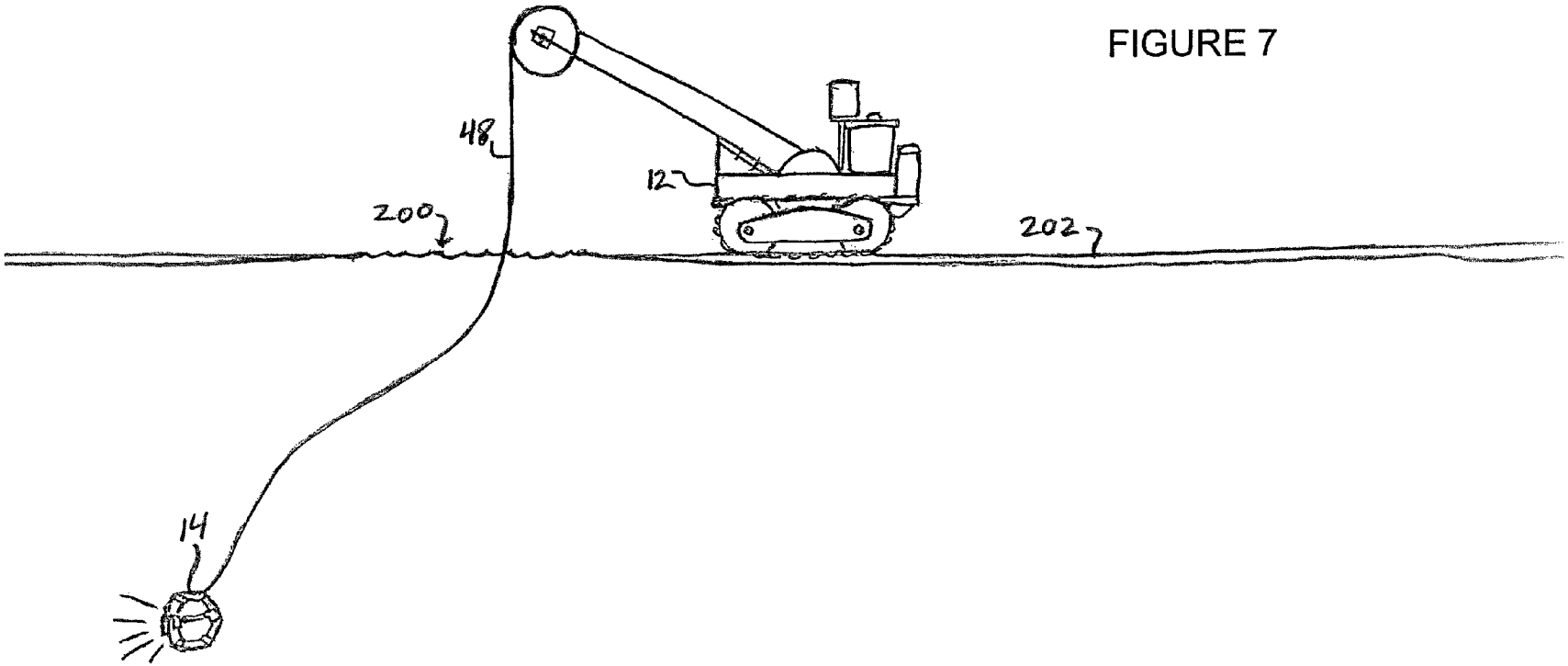
FIG. 7 is a side view of the embodiment shown in FIG. 1, with the submersible ROV deployed under water.
Figure 8:
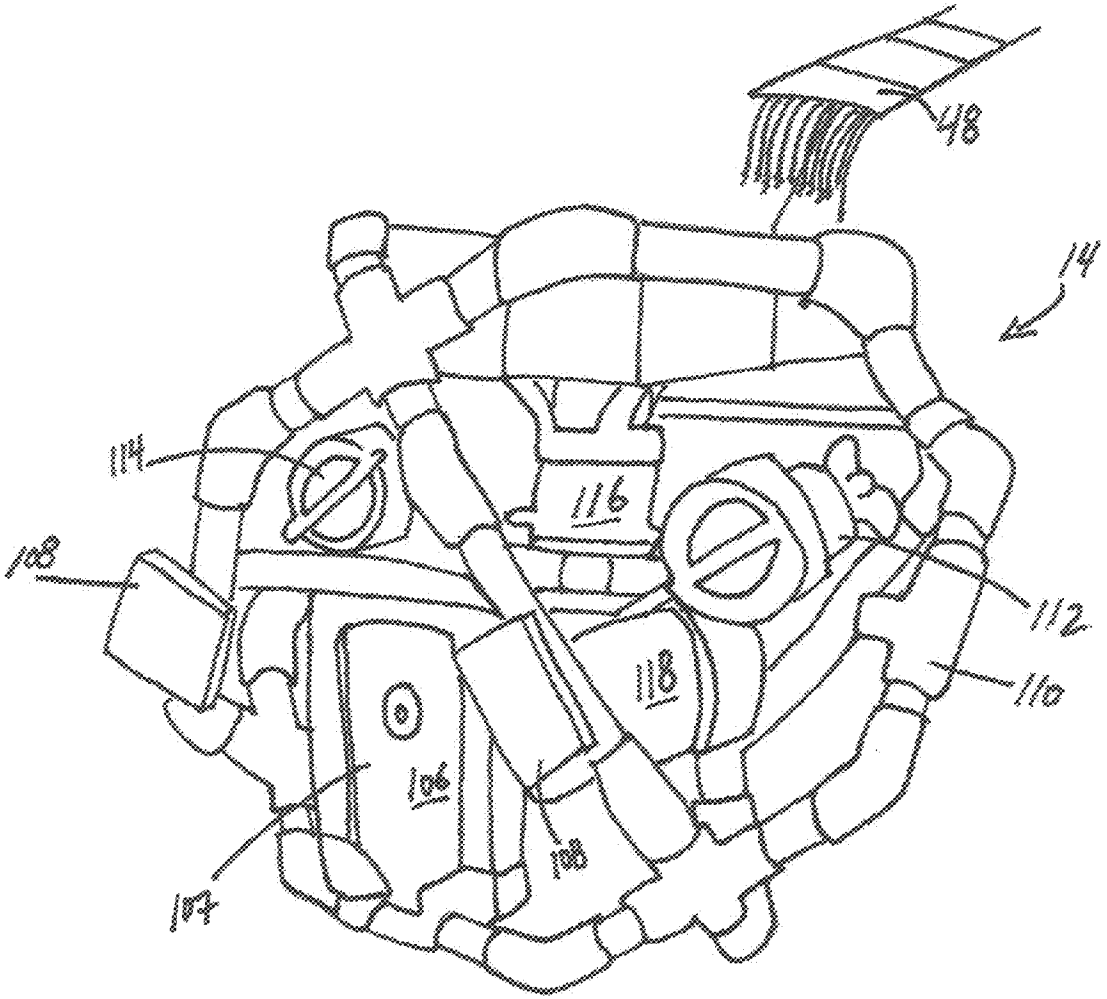
FIG. 8 is front perspective view of the submersible ROV shown in FIG. 1.
Figure 9:
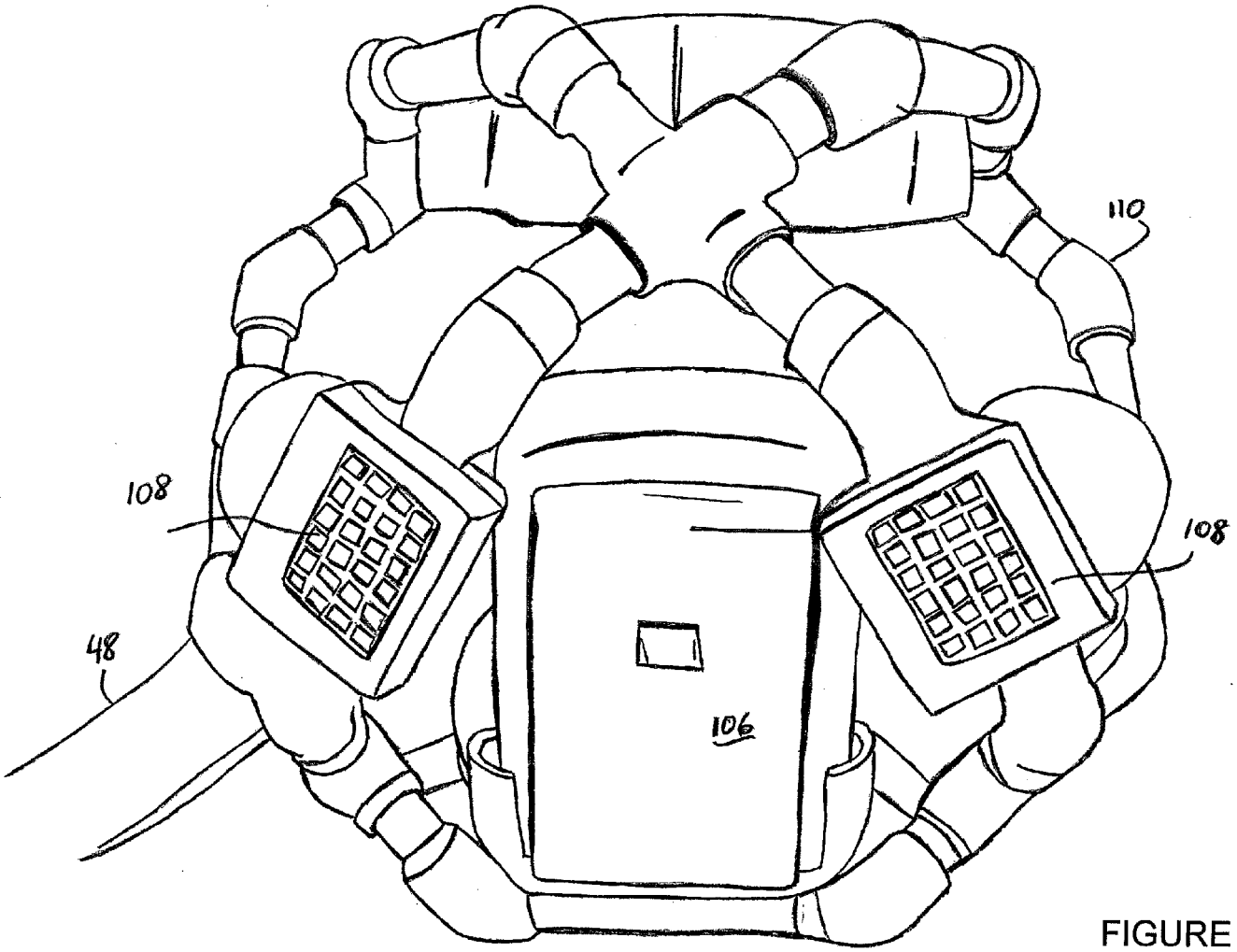
FIG. 9 is a front view of the submersible ROV shown in FIG. 8.

Referring now also to FIGS. 7-9, the search ROV 14 comprises a structural frame 110 upon or within which are disposed the remaining parts of the ROV, including information-gathering and sensing part(s), power part(s), flotation and component-orientation part(s) and propulsion part(s). The frame 110 can be constructed of any lightweight, strong material(s), such as light weight metal (e.g., aluminum), plastic tubing (e.g., PVC tubing), materials having enclosed spaces (such as honeycomb materials), and the like. Preferably the frame materials have the ability to float, such as sealed tubes, rigid foams, materials having enclosed spaces, and the like. The frame materials can be filled with a gas (including air), or comprise positive flotation materials such as foams to contribute to buoyancy of the frame and the ROV. In the embodiment illustrated in FIGS. 5 and 6, the frame material is PVC pipe.

In the described embodiment, the frame 110 is constructed in the form of a cage defining a central opening. The central opening provides a space for the various parts of the search ROV.

The information-gathering and sensing part(s), power part(s), flotation and component-orientation part(s) and propulsion part(s) are connected to the frame by any fastener materials or fastener devices. Fastener materials can include glues and epoxies. Fastener devices can also include brackets, ties (such as zip ties), and flexible metal sheaths.

The information gathering and sensing part(s) permit the operator of the robot to view surroundings, such as underwater. The information gathering and sensing part(s) can include light(s) 108 and camera(s) 106. The lights 108 provide illumination while the ROV is underwater, to facilitate searching underwater for objects, such as a person who has fallen through the ice. The lights 108 are electrically connected to and powered by the power source (e.g., the battery 32) via the tether 48. The lights 108 are connected to the ROV frame, and are oriented to provide light for the camera 106. In the illustrated embodiment, the lights 108 are LEDs, which connect to the power from the tether 48 via a DC-DC converter (not shown) within a sealed container 118 mounted within the frame 110. The lights 108 are encased in a waterproof, light-transmissible housing, such as a clear waterproof case, or are molded into clear solid casings, which may be formed of clear epoxy or polymeric materials. The lights 108 are mounted on the ROV frame using fastener materials or fastener devices as described herein.

The camera 106 provides the remote operator of the ROV with a view underwater in order to search for a victim's body or other object, to determine orientation of the ROV, etc. The camera 106 provides video images of the ROV's surroundings underwater, which permits the ROV operator to direct the ROV's movements to perform search operations underwater. The camera 106 is enclosed within a watertight housing 107, such as a sealed case that is transparent at least where the camera lens is directed, which allows the camera to obtain images underwater but without any risks to the lens or other parts of the camera. The case may be partially constructed of non-transparent materials, such as marine grade aluminum. The camera 106 is powered and provides signals via an Ethernet connection. The camera 106 is mounted on the ROV frame using fastener materials or fastener devices as described herein. Alternatives to a camera include sonar devices, infrared or ultraviolet cameras, or a special purpose waterproof camera.

In the described embodiment, the propulsion system includes two horizontal thrusters 112, 114 and a vertical thruster 116 that provide coordinated propulsion to permit the ROV to move underwater in any direction. Each thruster typically includes a reversible motor that spins a propeller to provide thrust. The thrusters are mounted on the frame using brackets or other fastener devices such as ties (such as plastic zip ties) and metal brackets. This particular configuration of thrusters provides thrust in multiple directions for fine control of the movements of the ROV, including straight-line movement and spinning of the ROV. In the described embodiment, thrusters 112 and 114 are spaced apart in parallel with a forward orientation, and thruster 116 is centrally located within the frame 110 and oriented vertically. The thrusters draw power from a power source via power cables or other electrical connectors. The thrusters 112, 114, 116 are controlled remotely, either wirelessly or via a wired connection, by an operator.

In the search ROV embodiment depicted in the figures, the power and communication signals are carried via the tether 48 to a sealed housing 118. Inside the housing 118 is a dc-dc converter for operation of the thrusters and the camera. In other embodiments, batteries or other independent power sources can be included in the housing 118.

The flotation and component-orientation part(s) (which are not shown in the figures to permit full view of the other parts), which also may be referred to herein as "floats," serve two purposes: (1) flotation and (2) orientation of the ROV so that the frame remains upright when under water. To provide flotation, the floats balance the weight of the ROV 100, but should not provide so much buoyancy such that the submersible unit 100 is not able to go below the surface of the water (or below ice). The floats can include foams, including closed-cell foams; inflatable bladders, including balloons; and mechanically expanding floatation devices. In some embodiments the foam is substantially free of bubbles. In preferred embodiments, the foam has low compressibility such that it retains shape and structure under pressures experienced under water, such as solid polystyrene foam.

The floats can be added to the outside of the frame and/or within the central opening of the frame. The floats can be attached to the frame by any standard fastener materials or fastener devices. Fastener materials can include glues and epoxies. Fastener devices can include brackets and ties (such as zip ties or metal ties). Floats can also be molded around the frame or around other parts of the ROV, as long as the floats do not interfere with any of the functions of the ROV. To provide orientation of the ROV, the floats should be positioned toward the top portion of the frame and/or within the portion of the central opening of the frame that is proximal to the top of the frame. Preferably the float is placed as close to the top of the frame as possible.

Software

Any software suitable for control of robots may be used to control the functions provided by the various parts of the search ROV 14, land vehicle 12 and deployment. In some embodiments, the software is Cross-link Robot Control System. The Cross-link Robot Control System is a modular based control system that uses a Controller Area Network (CAN) to communicate between multiple components with various functions. The Cross-link Robot Control System program can be wired to inputs, such as gamepads and joysticks, to control outputs, such as Jaguars/Victor Speed controllers, solenoids, relays, and digital outputs. The Cross-link Robot Control System also supports dual camera feeds, which allows for the video images from both the land vehicle camera and the ROV camera to be displayed on a laptop computer or other display device used by the remote operator.

Operation of the Multi-Component Robot

The robot is designed to be able to cross an icy surface and enter the water at the same point as the victim to carry out the preliminary search. To perform this complex task, the multi-component robot has connected components that permit movement over land or ice, and motion and image capture under water. The land vehicle 12 drives across the ice and deploys the search ROV 14 by lowering the search ROV, by the tether 48 attached to the search ROV, into a hole 200 in the ice 202. The motion of the ROV is controlled by a remote operator to carry out a search beneath the water for the victim, stirring up as little silt as possible. By controlling the position of the ROV and receiving images from the ROV camera, the operator can locate the target for a trained diver to swim to and retrieve. If can also be controlled to signal a diver already in the water, such as by flashing its lights to indicate that it found the target.

What is claimed is:

1. A remotely-controlled apparatus adapted for surface motion and deploying an underwater search mechanism, comprising:

a first ROV (remotely operated vehicle) adapted for underwater motion and including a sensor capable of providing a sensor signal indicative of an underwater condition;

a second ROV adapted for surface motion; and a remotely operated deployment system attached to the second ROV and communicatively coupled to the first ROV, wherein the deployment system includes an extensible tether attached to the first ROV at a distal end, and wherein the deployment system is adapted for deploying the first ROV underwater and retrieving the first ROV from the water, for providing power signals to the first ROV, and for receiving the sensor signal from the first ROV, wherein the tether comprises a single flexible, flat, waterproof, multi-wire cable having sufficient tensile strength to permit being wound on a spool and deploy and retrieve the first ROV into and from a body of water, including a first conductive wire for carrying the sensor signal from the first ROV and a second conductive wire for carrying the power signals to the first ROV.

2. A remotely-controlled apparatus adapted for surface motion and deploying an underwater search mechanism, comprising:

a first ROV (remotely operated vehicle) adapted for underwater motion and including a sensor capable of providing a sensor signal indicative of an underwater condition;

a second ROV adapted for surface motion; and a remotely operated deployment system attached to the second ROV and communicatively coupled to the first ROV, wherein the deployment system includes an extensible tether attached to the first ROV at a distal end, and wherein the deployment system is adapted for deploying the first ROV underwater and retrieving the first ROV from the water, for providing power signals to the first ROV, and for receiving the sensor signal from the first ROV, wherein the first ROV comprises:

an open lattice frame;

a propulsion mechanism supported by and located substantially within the frame, wherein the propulsion mechanism receives the power signals from the deployment system to power and control the movement of the first ROV when submerged;

a sensor supported by the frame, wherein the sensor provides a sensor signal, corresponding to a sensed underwater characteristic, to the deployment system.

3. The apparatus of claim 2, wherein the propulsion mechanism comprises:

spaced apart first and second reversible thrusters that are aligned in parallel in a first direction to define a plane;

a third reversible thruster positioned to provide thrust is a second direction that is perpendicular to the first direction;

wherein the power signals include a first thruster signal providing power to the first thruster, a second thruster signal providing power to the second thruster, and a third thruster signal providing power to the third thruster, wherein the first and second thruster signals control the first and second thrusters respectively to propel the first ROV in the plane of the first and second thrusters, and the third thruster signal controls the third thruster to propel the first ROV perpendicular to the plane.

4. The apparatus of claim 2, wherein:

the sensor is an optical sensor, and the sensor signal is indicative of an optical image; and the first ROV further includes a lighting system adapted to illuminate an area in front of the optical sensor.

5. The apparatus of claim 2, wherein the first ROV further includes floats positioned within the open lattice frame providing buoyancy.

6. The apparatus of claim 5, wherein the floats are positioned to orient the first ROV upright when submersed under water.

7. A remotely-controlled apparatus adapted for surface motion and deploying an underwater search mechanism, comprising:

a first ROV (remotely operated vehicle) adapted for underwater motion and including a sensor capable of providing a sensor signal indicative of an underwater condition;

a second ROV adapted for surface motion; and a remotely operated deployment system attached to the second ROV and communicatively coupled to the first ROV, wherein the deployment system includes an extensible tether attached to the first ROV at a distal end, and wherein the deployment system is adapted for deploying the first ROV underwater and retrieving the first ROV from the water, for providing power signals to the first ROV, and for receiving the sensor signal from the first ROV, wherein the deployment system comprises:

a boom having a proximal end connected to the second ROV and a distal end extending beyond a front end of the second ROV, a pulley rotatably connected to the distal end of the boom, a spool rotatably connected to the second ROV by a rotatable hub, wherein the tether, having a proximal end attached to the spool near the hub and extends over the pulley; and a spool motor mechanism coupled to the hub to rotate the hub and spool to wind and unwind the tether on the spool;

wherein the spool includes a first slip-ring connector on one end to provide a rotatable power connection to the tether, and a second slip-ring connector on an opposite end to provide a rotatable communication connection to the tether.

8. The apparatus of claim 7, wherein the tether comprises a single flexible, flat, waterproof, multi-wire cable and wherein the deployment system comprises:

a boom having a proximal end connected to the second ROV and a distal end extending beyond a front end of the second ROV, a pulley rotatably connected to the distal end of the boom, a spool rotatably connected to the second ROV by a rotatable hub, wherein the tether, having a proximal end attached to the spool near the hub and extends over the pulley;

a spool motor mechanism coupled to the hub to rotate the hub and spool to wind and unwind the tether on the spool, and a tether guide connected to the boom and positioned between the pulley and the first ROV that guides the tether over the pulley.

9. The apparatus of claim 8, wherein the tether comprises a single flexible, flat, waterproof, multi-wire cable, and wherein the tether guide comprises a ring.

* * * * *